US007918618B2

(12) United States Patent
Zevin et al.

(10) Patent No.: US 7,918,618 B2
(45) Date of Patent: Apr. 5, 2011

(54) PRINTER HAVING PRINTHEAD ANGULATOR ASSEMBLY

(75) Inventors: Thomas Michael Zevin, Valencia, CA (US); Bob M. Brashear, Oxnard, CA (US)

(73) Assignee: ZIH Corp., Hamilton (BM)

( * ) Notice: Subject to any disclaimer, the term of this patent is extended or adjusted under 35 U.S.C. 154(b) by 960 days.

(21) Appl. No.: 11/684,884

(22) Filed: Mar. 12, 2007

(65) Prior Publication Data

US 2007/0212142 A1 Sep. 13, 2007

Related U.S. Application Data

(60) Provisional application No. 60/781,011, filed on Mar. 10, 2006.

(51) Int. Cl.
*B41J 2/315* (2006.01)
*B41J 29/02* (2006.01)

(52) U.S. Cl. ..... 400/120.16; 400/56; 400/120.17; 347/197

(58) Field of Classification Search ..... 400/55, 400/56, 120.16, 120.17; 347/197, 198
See application file for complete search history.

(56) References Cited

U.S. PATENT DOCUMENTS

| | | | | |
|---|---|---|---|---|
| 5,528,277 | A | 6/1996 | Nardone et al. | |
| 5,746,519 | A * | 5/1998 | Ricketts | 400/120.01 |
| 6,068,420 | A | 5/2000 | Austin et al. | |
| 2002/0135659 | A1 * | 9/2002 | Sato | 347/197 |

* cited by examiner

*Primary Examiner* — Leslie J Evanisko
(74) *Attorney, Agent, or Firm* — Alston & Bird LLP

(57) ABSTRACT

A printer assembly for printing on a supply of media traveling in a media direction. The printer generally includes a platen assembly, a print head assembly and a pivot member. The pivot member provides for pivoting of the print head assembly relative to the platen assembly to adjust for variations in the media as it passes therebetween. Advantageously, the pivot member may be supported directly by the platen assembly, such as by bearing supports of the platen assembly, to reduce positioning error from intervening components. Preferably, the pivot member is positioned upstream of the print head assembly. Also, a pair of pivot members may each be supported at the ends of an angulation arm which is coupled to the print head assembly for angulation in the media direction but is uncoupled in the cross-media direction.

13 Claims, 8 Drawing Sheets

PRINTER HAVING PRINTHEAD ANGULATOR ASSEMBLY

CROSS-REFERENCE TO RELATED APPLICATIONS

This application claims priority from U.S. Provisional Application No. 60/781,011, filed Mar. 10, 2006, which is hereby incorporated herein in its entirety by reference.

BACKGROUND OF THE INVENTION

1. Field of the Invention

The present invention is related to printers and more particularly print head assemblies of printers.

2. Description of Related Art

Controlling printing quality often requires proper, accurate registration between a print head and the underlying printer media. Such registration can be difficult to maintain with variations in printer media, including the thickness of the printer ribbon and printer label or paper stock.

A conventional printer 10, such as shown in FIGS. 1 and 2, typically includes a printer frame 11 supporting a media supply 12, a ribbon supply 13, a platen assembly 17 and a print head assembly 14. The media supply can include a compartment 15 of paper, labels or other media, that is in a positioned generally above and upstream (with respect to movement of the media) of the print head assembly 14. The ribbon supply 13 includes a supply spool 24 that supplies a printer ribbon extending through the print head assembly 14 and onto a takeup spool 16. Both of the spools 14, 24 are rotatably supported by the printer frame 11. The platen assembly 17 includes a platen roller 18 that is rotatably supported by the printer frame 11 subjacent the print head assembly 14.

As shown in FIG. 2, the print head assembly 14 of the conventional printer 10 includes a print head ceramic base 19, an aluminum heat sink 20 and a pressure spring 21. The ceramic base 19 includes a print line which is a heating element that is selectively heated to pass ink from a ribbon or to directly thermal print onto the paper, label or other printable media. Supporting the print head ceramic base 19 is the heat sink 20 which itself is supported by a bracket 22. Ends of the bracket are rotatably supported by the printer frame 11, thereby allowing rotation of the heat sink 20 and the print head ceramic base 19 relative to the platen roller 18.

The print head assembly 14 of the conventional printer 10 also includes the pressure spring 21 that has a V-shape, as shown in FIGS. 1 and 2. The ends of the V-shape are supported by the printer frame 11 proximate ends of the rotatably supported bracket 22 and the pressure spring 21 extends downward onto a middle line of the bracket. In particular, the center of the V-shape has a line of contact due to the spring 21 being constructed of a ribbon of sheet metal that exerts a torque to control angulation as well as a downward bias on the bracket 22. These biases help to maintain contact of the ceramic base 19 and its print line with the ribbon and printer media passing between it and the platen roller 18.

Although helping the ceramic base 19 to maintain contact with the printer media and platen roller 18, the V-shaped pressure spring can interfere with passage of the media. Also, improvements in the ability of the print head assembly 14 to track the media are always desired.

Therefore, it would be advantageous to have a printer assembly that provides clearance for passage of media in a printer but still follows the media with accuracy for overall improved printing capability.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
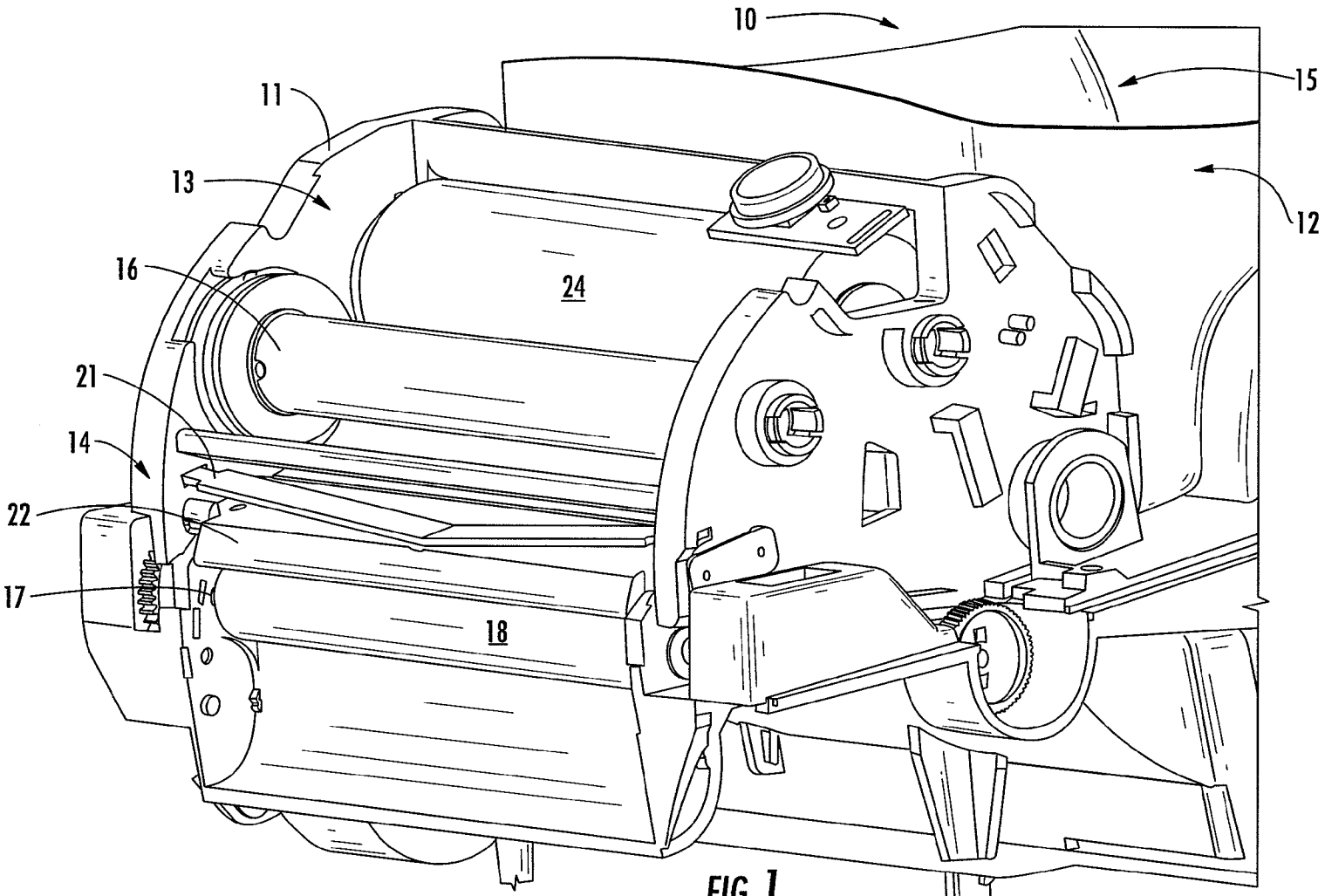
FIG. 1 (PRIOR ART)
FIG. 1 is a perspective view of a printer assembly of the prior art.
Figure 2:
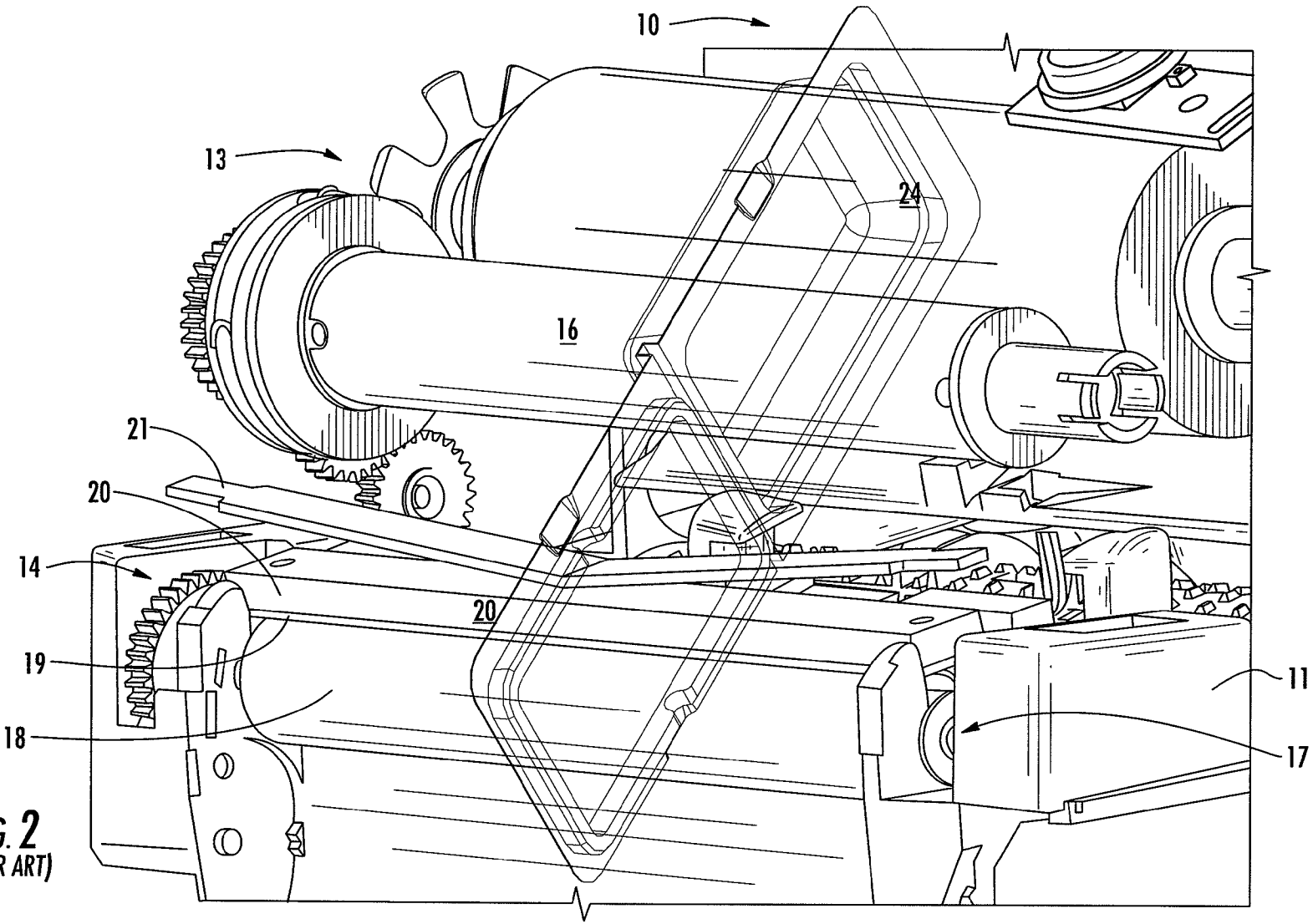
FIG. 2 (PRIOR ART)
FIG. 2 is another perspective view of the printer assembly of FIG. 1.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

The above needs are met and other advantages achieved by a printer assembly for printing on a supply of media traveling in a media direction of the present invention. The printer generally includes a platen assembly, a print head assembly and a pivot member. The pivot member provides for pivoting of the print head assembly relative to the platen assembly to adjust for variations in the media as it passes therebetween. Advantageously, the pivot member may be supported directly by the platen assembly, such as by bearing supports of the platen assembly, to reduce positioning error from intervening components. Preferably, the pivot member is positioned upstream of the print head assembly. Also, a pair of pivot members may each be supported at the ends of an angulation arm which is coupled to the print head assembly for angulation in the media direction but is uncoupled in the cross-media direction.

In one embodiment, the present invention includes a printer assembly for printing on a supply of media traveling in a media direction. The print head assembly includes a platen assembly configured to support the media. A print head assembly including a print line configured to print on the media as it passes between the print line and the platen. A biasing device of the printer assembly is configured to bias the print head assembly against the media supported by the platen. At least one pivot member is coupled to the print head assembly and pivotally supported relative to the print assembly. In this manner, the print line pivots about the pivot member in the media direction as the media travels between the print head assembly and the platen so as to adjust to variations in the media.

The pivot member may be supported directly by the platen assembly. For example, the print head assembly may be elongated and have a pair of opposite ends each supporting one of the pivot members. A pair of bearing supports rotatably support ends of the platen wherein each of the pivot members is supported by a respective one of the bearing supports. In this manner, the platen is configured to rotate on an axis and the pivot members are supported by a surface fixed relative to the axis.

In another aspect, the pivot members may be supported at ends of an angulation arm and the angulation arm is coupled to the print head assembly for pivoting in the media direction, but is uncoupled with respect to pivoting of the print head assembly across the media direction. For example, the angulation arm may have a coupling positioned midway between its ends that couples it to the print head assembly. The coupling may be a single post extending generally in the media direction from the angulation arm into an opening defined in the print head assembly, or vice versa. This allows the print head to follow the media in the cross-media direction.

The pivot member preferably defines a pivot surface approximating a point. For example, the pivot member may include a cone with a pointed free end defining a pivot surface. These cone pivot members can be supported at the ends of the angulation arm.

Figure 3:
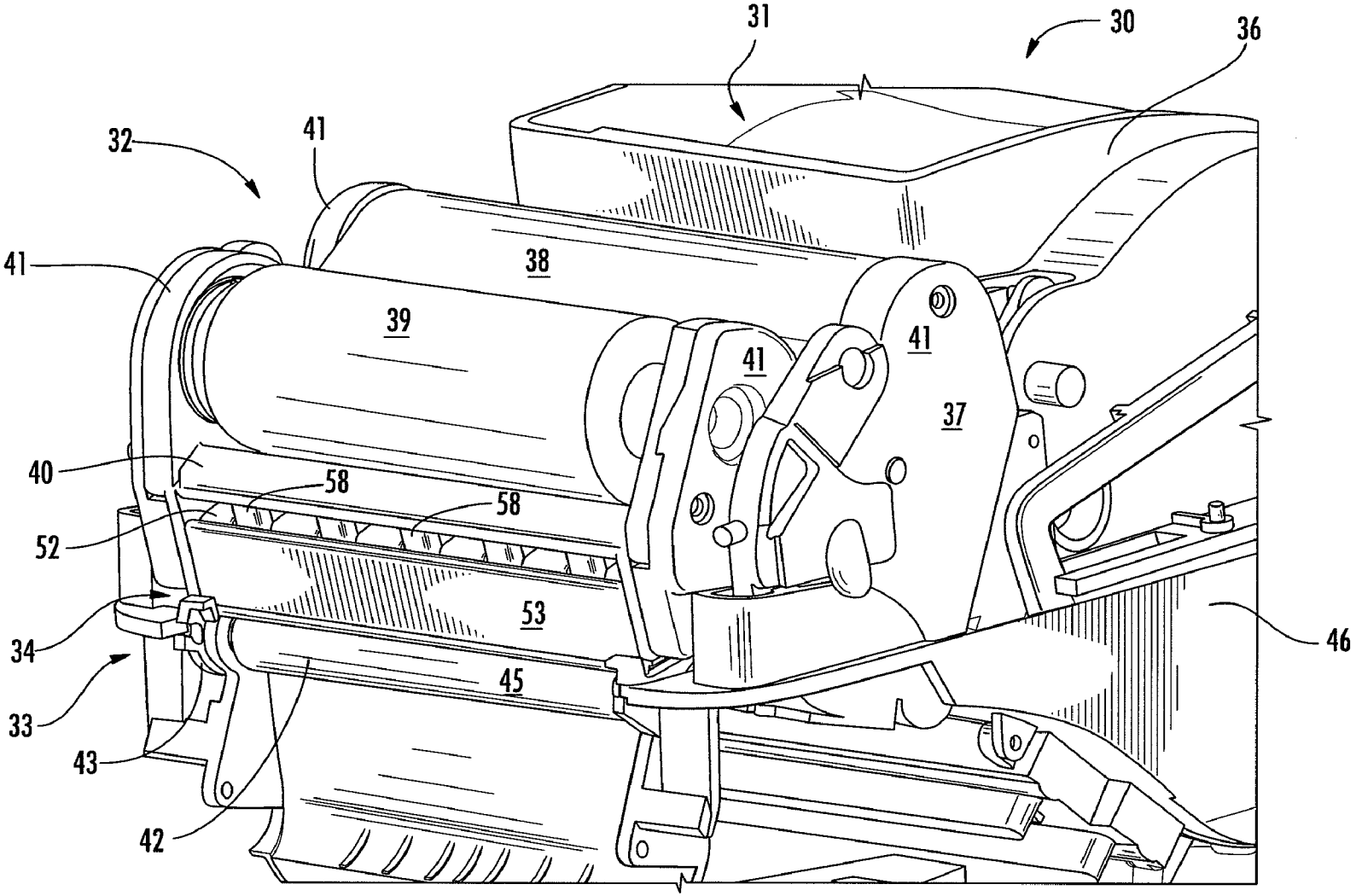
FIG. 3 is a perspective view of a printer assembly of one embodiment of the present invention.

Portions of a printer 30 of one embodiment of the present invention are shown in FIG. 3. The printer 30 includes, generally, a media supply 31, a ribbon supply 32, a platen assembly 33 and a print head assembly 34. As will be described below, the print head assembly 34 includes a pair of pivot points 35 that accurately facilitate angulation of a print line relative to the media and platen assembly 33.

It should be noted that although the illustrated printer 30 prints using a ribbon and thermal print head, the invention could be useful in any type of printer wherein a printer head needs to follow printer media, such as thermal transfer printing or a direct thermal printing on heat-sensitive media.

The media supply 31, as shown in FIG. 3, includes a media supply receptacle 36 that is positioned upstream (relative to media flow) and that is configured to hold media such as a supply of labels, cards or paper. Generally, the media supply receptacle 36 is accessible upon opening of a lid or cover of the printer 30 and, for example, can rotatably support a media supply roll. The media extends from the media supply receptacle 36 toward the print head assembly 34. It should be noted that the media supply 31 of the printer 30 of the present invention can be varied widely with the type of media, how the media is stored and how it is supplied and still be within the purview of the present invention. It should be noted that the present invention may be especially advantageously employed, however, for media that has varying thicknesses or inconsistencies such as label stock with embedded RFID tags.

The ribbon supply 32 includes a ribbon supply frame 37, a ribbon supply spool 38, a ribbon take-up spool 39 and a ribbon guide structure 40. The ribbon supply frame 37 includes two spaced walls positioned on opposite sides of the media supply path. Generally, each of the spaced walls includes two lobes 41 that extend upward away from the media path. A furthest upstream pair of the lobes spaced across the media supply path rotatably support the ribbon supply spool 38. Further downstream, and approximately above the print head assembly 34, a second spaced pair of lobes 41 rotatably supports the ribbon take-up spool 39.

Also supported by the ribbon supply frame 37 is the ribbon guide structure 40 which extends between the walls of the supply frame and has an edge positioned downstream and adjacent the ribbon take-up spool 39, as shown in FIG. 3. This edge helps the guide structure guide a ribbon passing onto the ribbon take-up spool 39. Generally, the ribbon guide structure 40 can be shaped and positioned as desired, such as at turns in the ribbon path, to ensure protected flow of the ribbon from the ribbon supply spool 38 to the ribbon take-up spool 39. Extending downward toward the media feed path from the ribbon guide structure 40 are a plurality of spring compression members 58 that have generally rectangular shapes and interact with the print head assembly 34 as described below.

Parts of the ribbon supply frame 37 could also be considered to be ribbon guide structure 40 and vice versa. Regardless, it should be noted that the ribbon supply 32 could have different configurations for supplying ribbon, or not be present at all where a ribbon supply is not required, and still be within the purview of the present invention. Further, the ribbon supply 32 might even include thermal transfer ribbon supply features when the print head assembly of the present invention is used in a thermal transfer printer.

Figure 5:
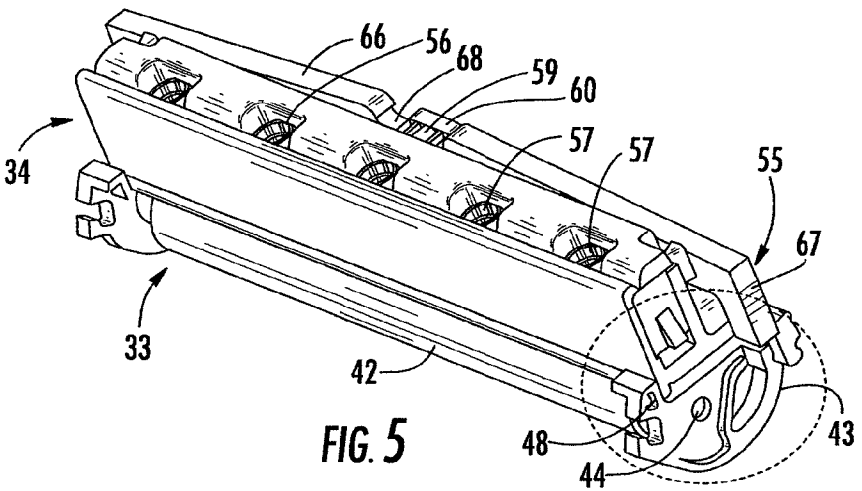
FIGS. 4 and 5 are perspective views of a print head assembly and a platen assembly of the printer assembly of FIG. 3.
Figure 6:
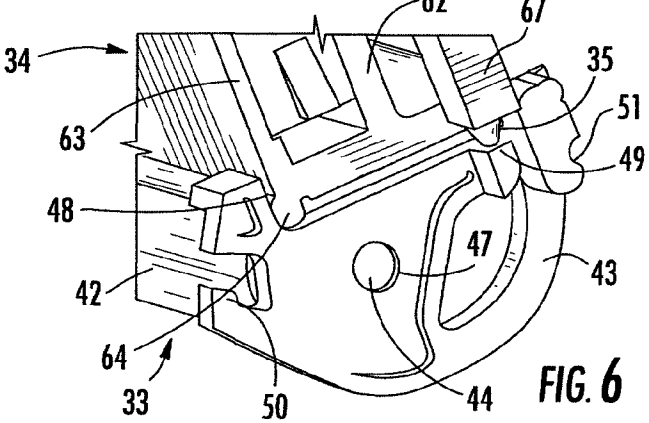
FIG. 6 is an enlarged view of the printer head and platen assemblies of FIG. 5.
Figure 4:
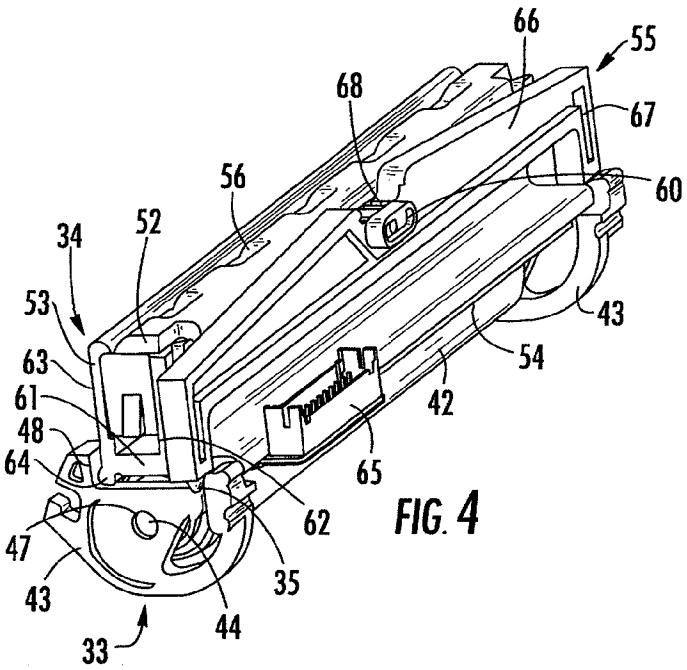

The platen assembly 33, as shown in FIG. 3, is positioned below the print head assembly 34 on the other side of the ribbon and printer media path. The platen assembly includes a platen roller 42 and a pair of bearing supports 43, as shown in FIGS. 4, 5 and 6. The platen roller 42 has a support portion 45 with cylindrical shape that extends cross the media travel path and subjacent the print head assembly 34 so as to support the printer media and ribbon media therefore.

The support portion 45 preferably has an outer surface configured to grip and move the printer media past the print head assembly 34. A shaft 44 of the platen roller 42 has a relatively smaller cylindrical diameter than the support portion 45 and extends from ends of the support portion. The ends of the shaft 44 extend through the pair of bearing supports 43 and into a lower frame 46 of the printer 30 where they are rotatably mounted, as shown in FIG. 3. One of the ends of the shaft 44 typically includes a gear that is driven by a motor assembly to advance the media past the print head assembly 34.

Each of the bearing supports 43, which may also be considered part of the print head assembly 34, have an overall semicircular disc shape defining a central opening 47, a heat sink support surface 48, a pivot support surface 49, a downstream notch 50 and a frame snap 51.

The central opening 47 allows passage of the shaft 44 of the platen roller 42 therethrough and into the lower frame 46 of the printer 30. In addition, the central opening 47 may also be configured to receive a bearing for rotatably supporting the shaft 44. The bearing supports, as shown in FIG. 3, are positioned in notches defined in the lower frame 46 wherein the ends of the shaft 44 extend away from the support portion 45 of the platen roller 42, through openings defined in the lower frame 46 and into the central opening 47 in each of the bearing supports 43.

The frame snap 51 is positioned upstream and defines a notch configured to grip a portion of the lower frame 46 of the printer 30. This connection inhibits rotational motion of the bearing supports 43 with respect to the lower frame 46. In addition, the frame snap 51 is positioned at the end of an arc-shaped arm that is free to flex under the forces of the passing media and movement of the platen roller 42. This facilitates the angulation of the print head 54 during printing.

The heat sink support surface 48 is defined by a flange positioned downstream and extending from a top edge of the bearing supports 43. This flange extends generally perpendicularly away from the media path and the heat sink support surface 48 accordingly extends at a right angle to the top edge of the bearing supports 43. The pivot support surface 49 extends parallel to the top edge and generally parallel to the media supply path. A plateau of each of the bearing supports 34 defines the pivot support surface 49 at a position upstream of the heat sink support surface 48.

As will be shown below, the bearing supports 43, and their respective heat sink and pivot support surfaces 48, 49 provide direct or near-direct reference points for the angulation of the print head. This is in contrast to conventional printers in which the angulation of the print head relative to the platen is controlled by several components, or there are several intervening components (e.g., V-shaped pressure spring 21, heat sink 20, bracket 22 and printer frame 11) between it and the platen.

The print head assembly 34 includes a spring housing 52, a heat sink 53, a print head 54 and an angulation arm 55, as shown in FIGS. 3-6. The spring housing has an elongate rectangular shape and extends across the media feed path so that its ends are over the bearing supports 43. Defined along the length of the spring housing 52 are a plurality of spring receptacles 56. The spring receptacles 56 have top openings extending away from the media feed path wherein each of the spring receptacles is configured to receive one of a plurality of coil springs 57, as shown in FIG. 5. In addition, the spring receptacles 56 are spaced and shaped to correspond to the rectangular spring compression members 58 which extend into the receptacles from the ribbon guide structure 40 fixed to the printer frame. In this manner, a downward bias is exerted on the print head assembly 34 to help it to follow the surface of the media as it passes thereunder.

Although there are five springs 57 in the illustrated embodiment, this number may vary, such as by using more springs for a greater cumulative bias, or allowing the use of lesser-biased springs, or less springs for less bias. The use of coil springs is advantageous in that they are generally more cost effective than other springs, such as the V-shaped spring 23, but other types of springs could also be employed, such as leaf springs, as long as some bias is imparted on the print head 54 in the direction of the printer media. The use of less expensive springs is facilitated by the pivoting action of the print head assembly 34 of the present invention which does not require any precisely defined spring behavior to cause angulation.

The spring housing 52 also includes a post 59 that ends in a flange 60. The post has a cylindrical shape and extends upstream, generally parallel with the path of the media and from a center position on the spring housing 52. The post 59 provides a rotatable mounting for the angulation arm 55, as shown in FIGS. 4 and 5. The flange 60 at the end of the post 59 holds the angulation arm 55 on the post 59 by abutting an upstream surface of the angulation arm 55. This mounting uncouples movement of the angulation arm 55 and the spring housing 52 across the media path but, due to the orientation of the post 59 and the flange 60, couples rotation or tilt in the direction of the media. Generally, the cross media direction rotation is controlled by the bias of the coil springs 57 and contact with the platen 44 which provides the most direct feedback on side-to-side positioning.

The heat sink 53 also extends across the media path to the top edges of the two bearing supports 43. The heat sink 53 is preferably constructed by extrusion and has various structures that advantageously eliminate the need for an intervening bracket between the print head 54 and the media and platen assembly 33. The illustrated heat sink 53, for example, includes a base wall 61, an upstream wall 62, a downstream wall 63 and a bull nose 64 that all extend continuously along its length, due to its extruded manufacture. Notably, however, the heat sink 53 could also be constructed using other methods and still have similar structural characteristics. Preferably, the heat sink is made of a metal or other material that conducts heat away from the print head 54 and this function is facilitated by the aforementioned wall structure.

The base wall 61 is planar and extends (except for the tilt when following the media) generally parallel to and in the direction of media flow. The base wall 61 has an upstream free edge and downstream supports the upstream wall 62 and downstream wall 63 that extend perpendicularly therefrom. The walls 62, 63 are spaced apart so as to provide a slot for holding the spring housing 52 therebetween. In this manner, the spring housing 52 and the heat sink 53 are fixed with respect to each other. Extending from the intersection of the downstream wall 63 and the base wall 61 is the bull nose 64.

The bull nose 64, as shown in FIG. 6, has a rounded cross-section and is positioned proximate the media path and the underlying platen roller 42. In addition, the bull nose 64 is configured to extend up and along the heat sink support surface 48 on the bearing supports 43 due to the tilt of the print head assembly 34 and the pressure of the media moving, via rotation of the platen roller 42, in the media direction under the print head assembly. The shape of the bull nose 64 eases the passage of ribbon media over itself and onto the ribbon take-up spool 39.

The print head 54 is positioned at the media interface of the outside surface of the base wall 61. The print head includes a burn line that extends across the media path and is controlled and energized by a multiple pin connector 65 that extends along the base wall 61 and past the free edge of the base wall in the upstream direction as shown in FIG. 4. The connector is in turn connected to a controller and power supply that enables selective heating of the burn line and printing on the passing media. It should be noted that although a linear, thermal print head 54 is shown, the present invention may be used with any of a range of print heads, such as ink-jet print heads, wherein the positioning of the print head and its ability to follow the media is important for print quality.

Figure 7:
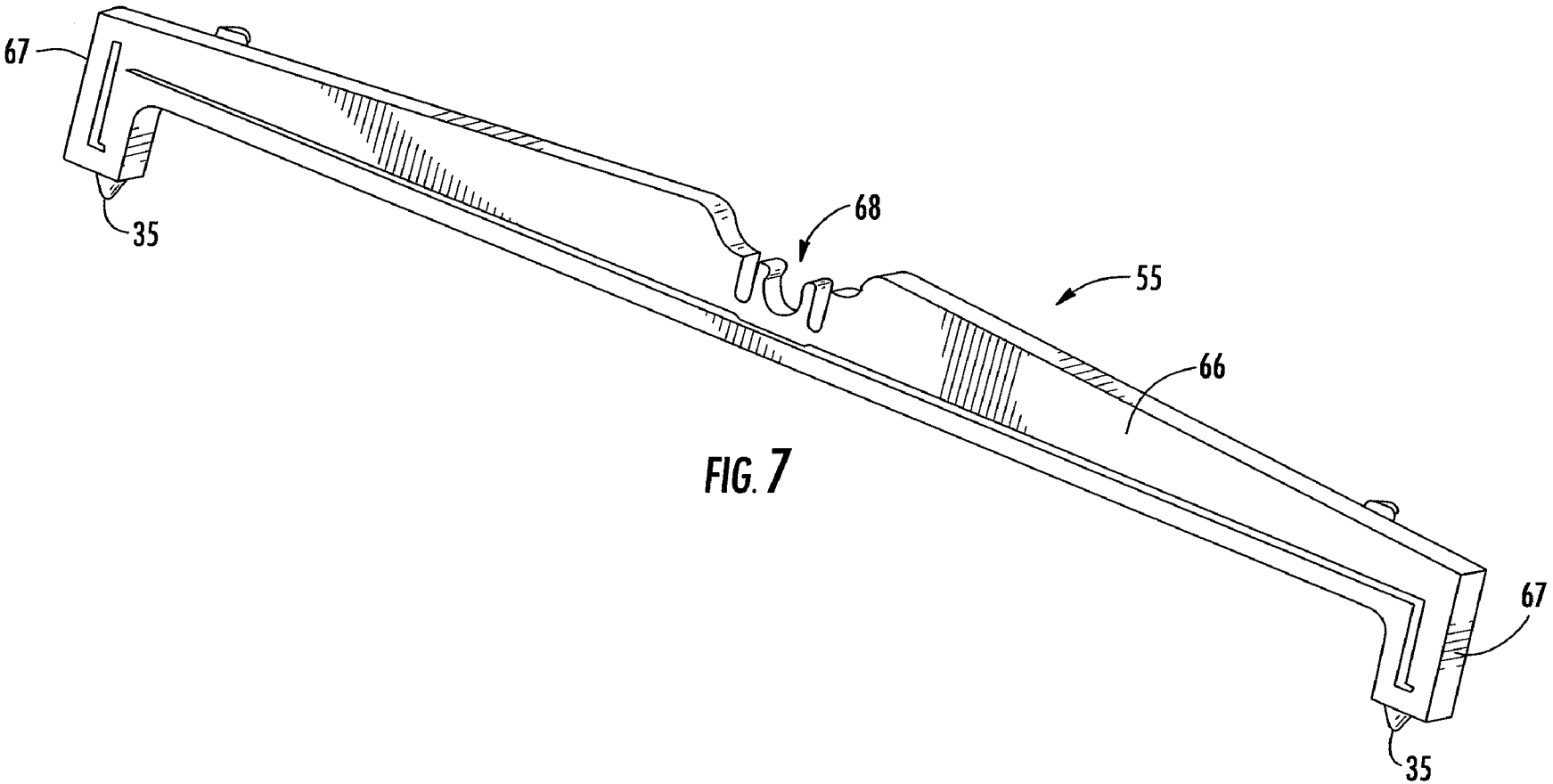
FIG. 7 is a perspective view of an angulation arm of the printer assembly of FIG. 3.

The angulation arm 55 includes a crossbar 66, a pair of legs 67 and a post grip 68, as shown in FIG. 7. The crossbar 66 extends approximately the width of the media path and supports the legs 67 at its ends, wherein each of the legs extends in the direction of a respective one of the bearing supports 43. The post grip 68 is defined at the center of the crossbar and includes an opening sized to snap-fit around, but allow rotation relative to, the post 59 of the spring housing 52. As described above, this connection and motion uncouples rotation of the spring housing 52 and the angulation arm 55 across the media path.

One of a pair of pivot points 35 is supported by the end of each of the legs 67. The term "pivot point" as used herein refers to a relatively small-area which supports pivoting of the print head assembly 34 relative to the platen assembly 33. For example, as shown in FIG. 6, the pivot points are at the ends of a pair of conical shaped members that come to a point at their free ends. These pivot points 35 are configured to rest on the pivot support surface 49 of each of the bearing supports 43. They are free to slide and pivot with respect to the bearing supports 43 as the downstream print head 54 follows the varying thickness of ribbon and printer media between it and the platen roller 42. Advantageously, the common, singular part reference of the bearing supports 43 and the pivot support surface 49 reduces the tolerance stack up associated with multiple intervening parts between the print head 54 and the platen roller 42.

During operation of the printer 30, the media, such as label or card stock, is dispensed from the media supply receptacle 36 downstream toward the platen assembly 33 and the print head assembly 34. At the same time, the ribbon media extends off of the ribbon supply spool 38 toward the platen assembly 33 and the print head assembly 34. The printer ribbon extends over bull nose 64 of the heat sink 53 and over the burn line of the print head 54 and onto the ribbon take-up spool 39. The printer media extends over the outer surface of the support portion 45 of the platen roller 42 and is urged downstream by the driving of the platen roller. Variations in the printer media and ribbon media urge the print head 54, heat sink 53 and spring housing 52 toward the spring compression members 58, thereby compressing the springs 57 and angling the print head 54 to rotate about the pivot points 35. The pivot points 35 tilt and/or slip against the pivot support surface 49 of the bearing supports 43, thereby controlling the amount of tilt with respect to the platen roller 42. Thus, a torque resisting the tilt and causing the print head 54 to follow the media surface is generated and without the use of an expensive custom spring.

Figure 8:
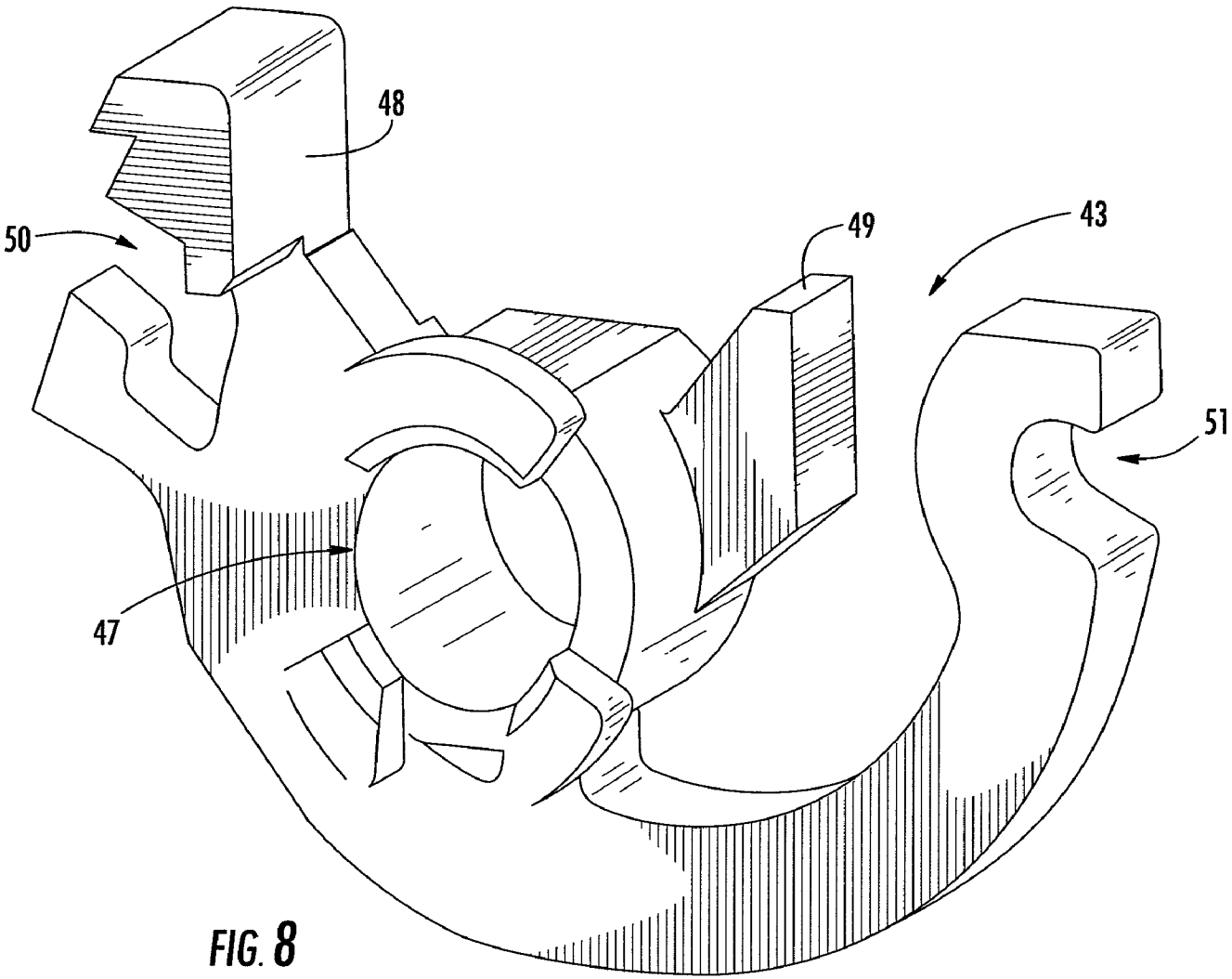
FIG. 8 is a perspective view of a platen bearing support member of another embodiment of the present invention.
Figure 9:
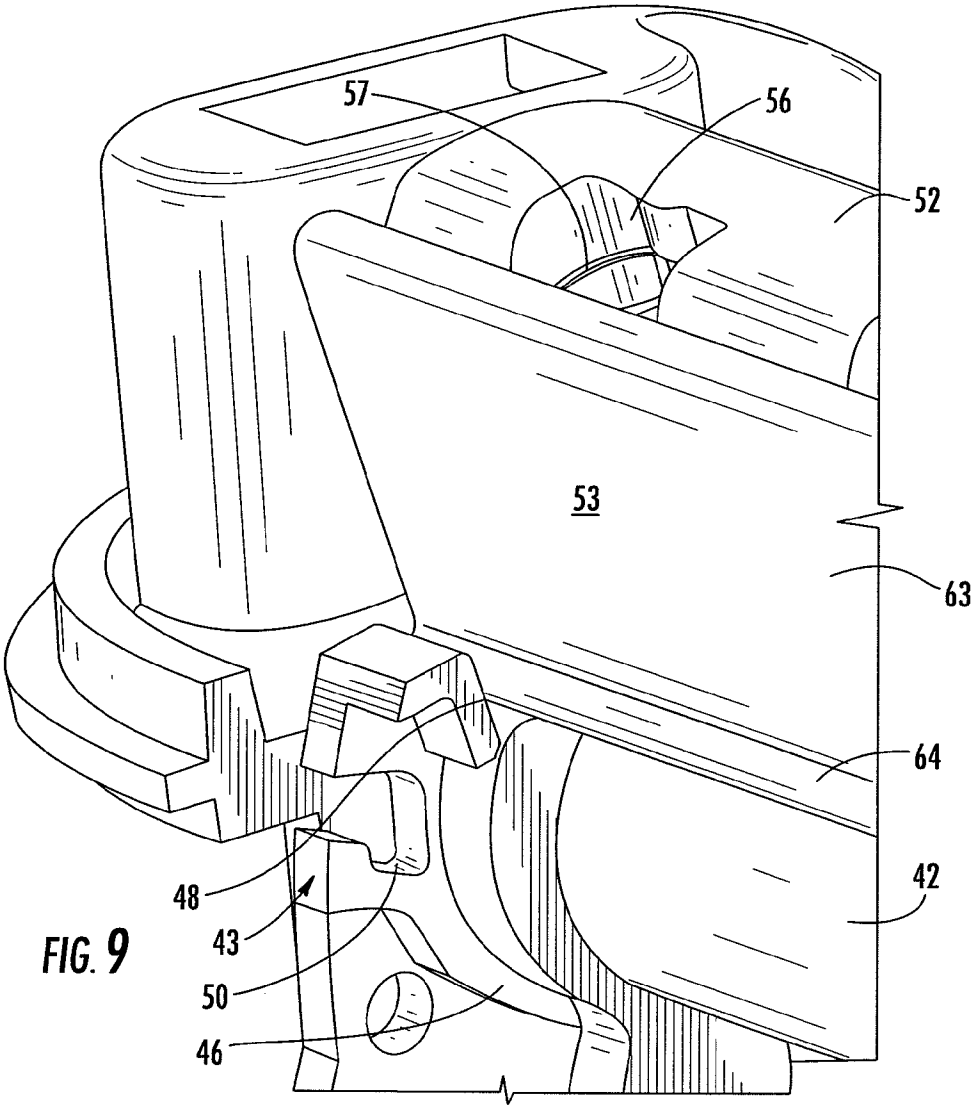
FIGS. 9 and 10 are perspective views of the platen bearing support member of FIG. 8 assembled in a printer assembly of the present invention.
Figure 10:
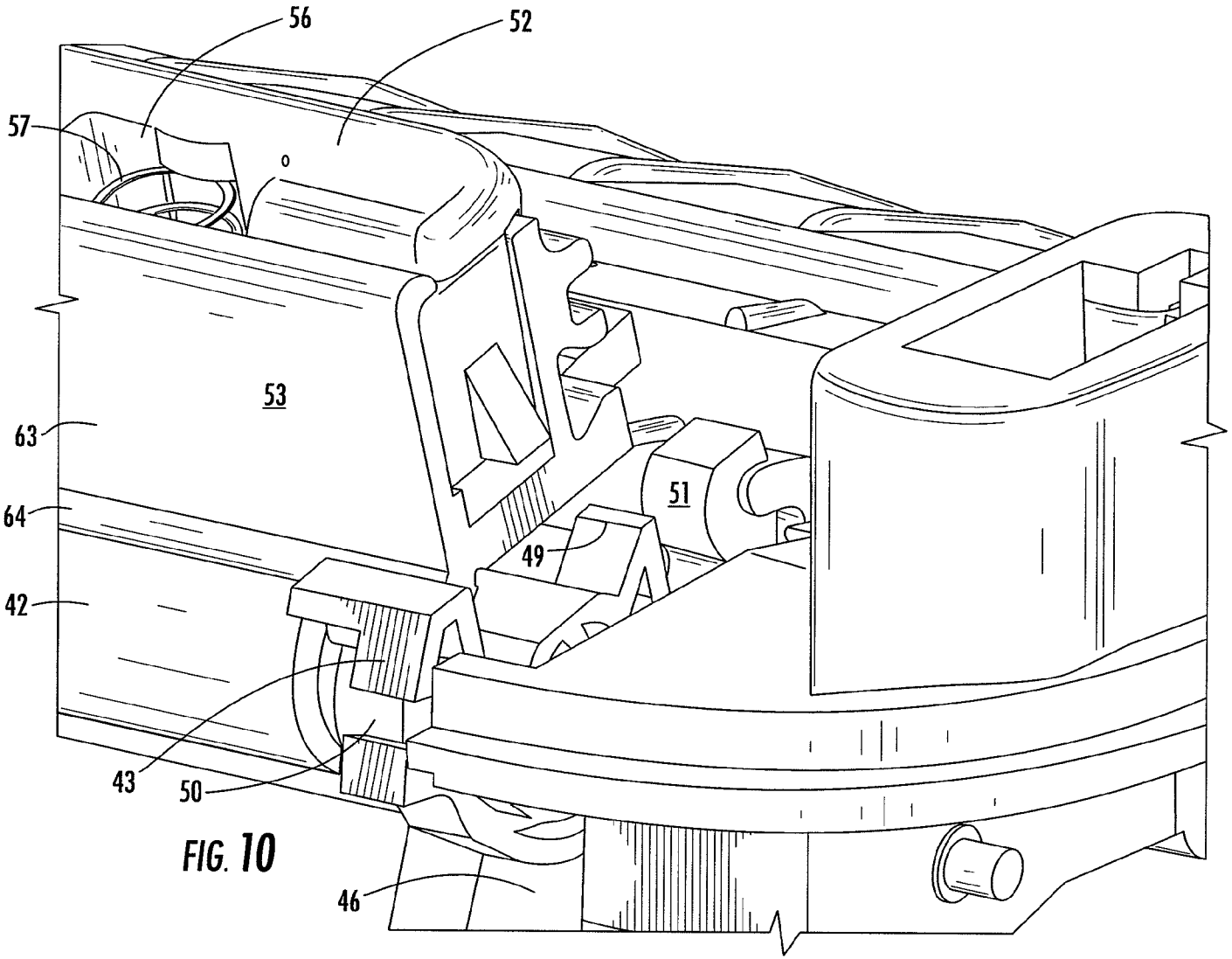

In another embodiment, the present invention includes a variation in the bearing supports 43, as shown in FIGS. 8, 9 and 10. This embodiment lacks the upper edge of the initially illustrated embodiment but still includes the central opening 47, heat sink support surface 48 and the pivot support surface 49.

The present invention has many advantages. The use of the print head locating features, such as the heat sink support surface 48 and the pivot support surface 49, reduces tolerance stack up when compared to conventional printers. The springs need not generate a torque or precise placement and therefore can be less expensive coil springs. The extruded heat sink 53 has components such as the bull nose 64 and base wall 61 supporting the print head 54 directly, that improves precision location of the print head 54 and eliminates an intervening bracket.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A printer assembly for printing on a supply of media traveling in a media direction, said printer assembly comprising:

a platen assembly comprising a platen that is configured to rotate on a platen axis and further configured to support the media;

a print head assembly comprising a print line configured to print on the media as the media passes between the print line and the platen assembly wherein the print head assembly is elongated and has a pair of opposite ends;

at least one biasing device configured to bias the print head assembly against the media supported by the platen assembly;

an angulation arm that is elongated and defines two ends; and a pair of pivot members extending from the angulation arm proximate respective ends of the angulation arm and adjacent a respective one of the opposite ends of the print head assembly, wherein the pair of pivot members are pivotally supported by a surface that is fixed relative to the platen axis, wherein the angulation arm is coupled to the print head assembly such that the print head assembly pivots about the pair of pivot members and tilts in the media direction as the media travels between the print head assembly and the platen assembly so as to adjust to variations of the media, and wherein the angulation arm is uncoupled to the print head assembly with respect to pivoting of the print head assembly in a direction transverse to the media direction.

2. A printer assembly of claim 1, wherein the platen assembly includes a pair of bearing supports rotatably supporting ends of the platen and wherein each of the pivot members is supported by a respective one of the bearing supports.

3. A printer assembly of claim 1, wherein the angulation arm has a coupling positioned approximately midway between the ends of the angulation arm and coupling the angulation arm to the print head assembly.

4. A printer assembly of claim 3, wherein the coupling is a single post extending generally in the media direction from one of the angulation arm or the print head assembly into an opening defined in another of the angulation arm or the print head assembly.

5. A printer assembly of claim 4, wherein the post extends from the print head assembly to the opening defined in the angulation arm.

6. A printer assembly of claim 1, wherein the pair of pivot members are positioned upstream of the print line with respect to the media direction.

7. A printer assembly of claim 1, wherein the pair of pivot members are each configured to define a pivot surface approximating a point.

8. A printer assembly of claim 7, wherein the pair of pivot members each include a cone having with a free end defining the pivot surface.

9. A printer assembly for printing on a supply of media traveling in a media direction, said printer assembly comprising:

a platen assembly configured to support the media;

a print head assembly including a print line configured to print on the media as the media passes between the print line and the platen assembly wherein the print head assembly includes a heat sink and a print head, said heat sink supporting the print head and said print head supporting the print line and wherein the heat sink and print head are elongate, have opposite ends and are generally coextensive;

at least one biasing device configured to bias the print head assembly against the media supported by the platen assembly;

an angulation arm extending generally coextensive with the heat sink and print head comprising a coupling positioned midway between the ends of the angulation arm and coupling the angulation arm to the print head assembly with respect to pivoting in the media direction; and a pair of pivot members coupled to the print head assembly and pivotally supported at opposite ends of the angulation arm relative to the platen assembly;

wherein the print line pivots about the pivot member and tilts in the media direction as the media travels between the print head assembly and the platen assembly so as to adjust to variations of the media.

10. A printer assembly of claim 9, wherein the coupling is configured to allow relative rotation of the angulation arm and the print head assembly across the media direction.

11. A printer assembly of claim 10, wherein the heat sink includes a bull nose extending across the media upstream of the print line.

12. A printer assembly of claim 11, wherein the platen is rotatably supported at its ends by a pair of roller bearings.

13. A printer assembly of claim 12, wherein the roller bearings define a support surface configured to support the pivot members and another support surface configured to support the bull nose.

* * * * *